US010479644B2

(12) United States Patent
Vierke

(10) Patent No.: US 10,479,644 B2
(45) Date of Patent: Nov. 19, 2019

(54) ELEVATOR SYSTEM AND METHOD WITH ELEVATOR LINK HAVING INTEGRATED CONTROL LINES

(71) Applicant: FORUM US, INC., Houston, TX (US)

(72) Inventor: Andre Vierke, Hamburg (DE)

(73) Assignee: FORUM US, INC., Houston, TX (US)

( * ) Notice: Subject to any disclaimer, the term of this patent is extended or adjusted under 35 U.S.C. 154(b) by 0 days.

(21) Appl. No.: 15/667,806

(22) Filed: Aug. 3, 2017

(65) Prior Publication Data

US 2019/0039857 A1 Feb. 7, 2019

(51) Int. Cl.

| | |
|---|---|
| ***E21B 19/06*** | (2006.01) |
| ***B66B 1/24*** | (2006.01) |
| ***B66B 1/34*** | (2006.01) |
| ***B66B 7/02*** | (2006.01) |
| ***B66B 9/08*** | (2006.01) |
| ***E21B 19/02*** | (2006.01) |
| *E21B 43/12* | (2006.01) |

(52) U.S. Cl.

CPC ..... *B66B 1/2458* (2013.01); *B66B 1/3423* (2013.01); *B66B 1/3461* (2013.01); *B66B 7/025* (2013.01); *B66B 9/0861* (2013.01); *E21B 19/02* (2013.01); *E21B 19/06* (2013.01); *E21B 43/126* (2013.01)

(58) Field of Classification Search

CPC ..... E21B 19/06; E21B 43/126

See application file for complete search history.

(56) References Cited

U.S. PATENT DOCUMENTS

| | | | | |
|---|---|---|---|---|
| 1,810,978 | A | 6/1931 | Moore | |
| 2,242,783 | A * | 5/1941 | Grau | E21B 19/06 16/436 |
| 2,313,243 | A * | 3/1943 | Johnson | B66C 1/00 254/277 |
| 2,613,102 | A | 10/1952 | Roberson | |
| 2,616,747 | A | 11/1952 | Ratigan | |
| 3,461,666 | A | 8/1969 | Burstall | |
| 3,915,244 | A * | 10/1975 | Brown | E21B 19/07 166/77.52 |
| 4,793,422 | A | 12/1988 | Krasnov | |
| 4,800,968 | A | 1/1989 | Shaw | |
| 6,520,709 | B1 | 2/2003 | Mosing et al. | |
| 7,140,443 | B2 | 11/2006 | Beierbach et al. | |
| 7,296,630 | B2 * | 11/2007 | Severin | E21B 19/06 166/379 |
| 7,377,324 | B2 | 5/2008 | Beierbach et al. | |
| 9,080,396 | B2 | 7/2015 | Overland | |
| 9,476,268 | B2 * | 10/2016 | Pratt | E21B 19/06 |
| 2006/0191690 | A1 | 8/2006 | Severin et al. | |

(Continued)

FOREIGN PATENT DOCUMENTS

| | | | |
|---|---|---|---|
| EP | 0162000 | A1 | 11/1985 |
| WO | 2009025832 | A1 | 2/2009 |

OTHER PUBLICATIONS

PCT International Search Report dated Nov. 9, 2018 for Application No. PCT/US2018/041759.

*Primary Examiner* — Matthew R Buck
*Assistant Examiner* — Aaron L Lembo
(74) *Attorney, Agent, or Firm* — Patterson + Sheridan, LLP

(57) ABSTRACT

An elevator system for supporting tubulars having one or more elevator links with internal passages disposed through the elevator links to provide communication to and from the elevator.

25 Claims, 6 Drawing Sheets

(56) References Cited

U.S. PATENT DOCUMENTS

| | | | | |
|---|---|---|---|---|
| 2007/0062688 | A1 | 3/2007 | Schats et al. | |
| 2007/0251700 | A1* | 11/2007 | Mason | E21B 19/06 166/379 |
| 2009/0305077 | A1 | 12/2009 | Mizuguchi et al. | |
| 2010/0243325 | A1 | 9/2010 | Veeningen | |
| 2014/0262336 | A1* | 9/2014 | Nikiforuk | E21B 19/06 166/380 |
| 2016/0060977 | A1* | 3/2016 | Plain | E21B 19/006 166/355 |
| 2017/0016285 | A1 | 1/2017 | Pratt et al. | |
| 2018/0209226 | A1* | 7/2018 | Bergeron | E21B 19/06 |

* cited by examiner

ELEVATOR SYSTEM AND METHOD WITH ELEVATOR LINK HAVING INTEGRATED CONTROL LINES

BACKGROUND

Field

Embodiments described herein generally relate to elevator systems for supporting tubular members in the field of oil and gas production. The elevator systems have a fluid flowpath to provide fluid power in the elevator system.

Description of the Related Art

In the oil and gas industry, it is the usual practice to hoist various types of tubular members, such as drill strings, production tubing, and other pipes, on rigs with various elevators of different capacities. The elevator system includes an elevator connected to a top drive that is used to support and move the tubular members by rotating, raising and lowering the tubular members. The elevator is connected to the top drive using a pair of elevator links that may be referred to as elevator bails. The elevator links provide a connection between the elevator and the top drive. The elevator may be rotated, tilted, raised and lowered using the elevator links connecting the elevator to the top drive.

The elevator system is powered by hydraulic power or electric power to hold and move the tubular members. The elevator system may also be equipped with sensors, including optical and electrical sensors. A number of control lines, including supply and signal lines, may be needed to provide power and communication to the elevator system. The control lines may be hoses or other conduits that may run from the rig floor to the elevator and/or the top drive located above the elevator. Oftentimes, the control lines get tangled, damaged, or in the way of or otherwise interfere with personnel and/or other rig equipment that can disrupt the operation of the elevator and/or the top drive.

Therefore there is a need for new and/or improved systems and methods that safely and efficiently provide power and communication for the elevator system.

SUMMARY

Embodiments of the disclosure describe an apparatus and method for an elevator system that supports a tubular member used for production of oil and gas.

In one embodiment, an elevator system for supporting a tubular member comprises an elevator; a first elevator link connected to the elevator for supporting the elevator comprising a shaft having an upper shaft end and a lower shaft end; an upper eye coupled to the upper shaft end and having an upper eye body defining an upper eye opening; a lower eye coupled to the lower shaft end and having a lower eye body defining a lower eye opening; a first upper port and a first lower port disposed on the first elevator link; and a first internal passage extending through at least a portion of the shaft and in communication with the first upper port and the first lower port; and a second elevator link connected to the elevator for supporting the elevator.

In one embodiment, an elevator link configured to couple an elevator to a top drive for supporting a tubular member comprises a shaft having an upper shaft end and a lower shaft end; an upper eye coupled to the upper shaft end and having an upper eye body defining an upper eye opening; a lower eye coupled to the lower shaft end and having a lower eye body defining a lower eye opening; a first upper port and a first lower port disposed on the elevator link; and a first internal passage extending through at least a portion of the shaft and in communication with the first upper port and the first lower port.

In one embodiment, a method of supporting a tubular member with an elevator system comprises coupling a first control line to a first elevator link of the elevator system, wherein the first elevator link comprises a shaft, and a first upper port and a first lower port disposed on the elevator link, wherein a first internal passage extends through at least a portion of the shaft, and wherein the first internal passage is in communication with the first upper port and the first lower port; and pumping fluid through the first control line and through the first internal passage; and using the fluid as hydraulic power for the elevator system.

BRIEF DESCRIPTION OF THE DRAWINGS

So that the manner in which the above recited features of the disclosure can be understood in detail, a more particular description of the disclosure, briefly summarized above, may be had by reference to implementations, some of which are illustrated in the appended drawings. It is to be noted, however, that the appended drawings illustrate only selected implementations of this disclosure and are therefore not to be considered limiting of its scope, for the disclosure may admit to other equally effective implementations.

To facilitate understanding, identical reference numerals have been used, wherever possible, to designate identical elements that are common to the Figures. Additionally, elements of one implementation may be advantageously adapted for utilization in other implementations described herein.

DETAILED DESCRIPTION

Embodiments herein generally provide an elevator system with an elevator link having integrated control lines. The elevator system includes an elevator that is connected to a top drive by a pair of elevator links. At least one of the elevator links is configured to integrate control lines with the elevator link. A number of different control lines may be needed to provide hydraulic or electrical power and communication signals to the elevator system. The elevator link has at least one internal passage that extends longitudinally along the elevator link between a lower port formed at one end of the elevator link and an upper port formed at an opposite end of the elevator link. The internal passage may be used to extend a control line through the internal passage and through the lower port and the upper port of the elevator link. By using the internal passage of the elevator link, a plurality of control lines can be efficiently connected between the elevator and the top drive. Control lines forming loops and potentially becoming tangled or damaged during operation, for example by equipment external to the elevator link, is reduced.

Figure 1:
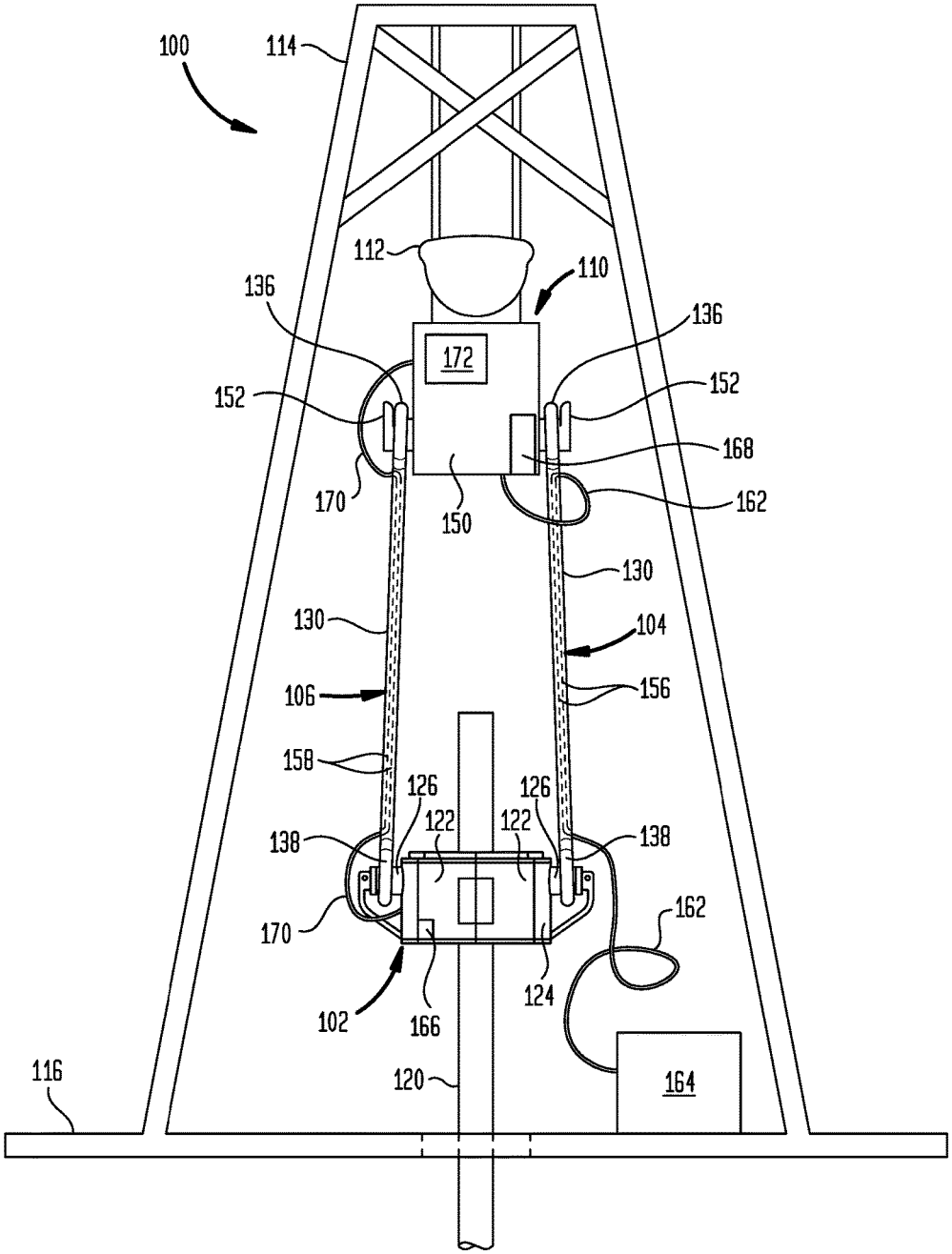
FIG. 1 depicts a schematic front view of an elevator system used on a rig, according to one embodiment.

FIG. 1 depicts a schematic front view of an elevator system 100 used on a rig 114 having a rig floor 116, according to one embodiment. The elevator system 100 includes an elevator 102, a first elevator link 104, a second elevator link 106, and a top drive 110. The elevator links 104, 106 couple the elevator 102 to the top drive 110. The top drive 110 may be coupled to a traveling block 112 that connects the top drive 110 to the rig 114.

As shown in FIG. 1, the elevator 102 supports a tubular member 120. The elevator 102 has elevator doors 122 that are in a closed position when the elevator 102 is supporting the tubular member 120. The elevator 102 has an elevator body 124 and a first elevator ear 126 and a second elevator ear 126. The elevator ears 126 each extend from the elevator body 124. The elevator ears 126 are used to connect with the elevator links 104, 106. The top drive 110 has a top drive body 150 having a pair of top drive connectors 152 extending from the top drive body 150. The elevator links 104, 106 each include a shaft 130 having an upper shaft end coupled to an upper eye 136, and a lower shaft end coupled to a lower eye 138. The upper eyes 136 of the elevator links 104, 106 are coupled to the top drive connectors 152, and the lower eyes 138 are coupled to the elevator ears 126.

A first passage system 156 extends through the first elevator link 104 and a second passage system 158 extends through the second elevator link 106, as depicted by dashed lines in FIG. 1. The passage systems 156, 158 are disposed in an internal section of elevator links 104, 106. The first passage system 156 includes at least one first internal passage 184 that extends through at least a portion of the first elevator link 104. The second passage system 158 includes at least one second internal passage 185 that extends through at least a portion of the second elevator link 106.

First control lines 162 extend from a control unit 164 on the rig floor 116 to the first elevator link 104 and to the top drive 110. The embodiment of the elevator system 100 in FIG. 1 includes a plurality of first control lines 162, and for simplicity the first control lines 162 are depicted by a single line in FIG. 1. In some embodiments, the first control lines 162 may be coupled to the elevator link 104 by extending the first control lines 162 to the elevator 102 and then extending the first control lines 162 to the first elevator link 104. The first control unit 164 may include a hydraulic power unit (HPU), pressurized gas unit, electric power unit, optical power unit or controller for sending and receiving signals. In some embodiments, each first control line 162 includes an upper line section coupled to and in fluid communication with the elevator link 104 towards a top end of the elevator link 104, and a lower line section coupled to and in fluid communication with the elevator link 104 towards a lower end of the elevator link 104.

Second control lines 170 extend from the top drive 110 to the second elevator link 106. The second control lines 170 extend through the second passage system 158 of the second elevator link 106 and to the elevator 102. A second control unit 172 is attached to or disposed proximate the top drive 110. The second control line 170 may extend from the second control unit 172. The second control unit 172 may include a hydraulic power unit (HPU), pressurized gas unit, electric power unit, optical power unit or controller for sending and receiving signals. In some embodiments, the elevator system 100 may include only one passage system 156, 158 extending through one of the elevator links 104, 106. In some embodiments, the elevator system 100 may include only one control unit 164, 172.

The first control lines 162 and second control lines 170 may be formed by hoses or fluid conduits that transport pressurized fluid, electrical or optical communication lines, or electrical power transmission lines. In different embodiments, there may be one to ten control lines 162, 170. For example, the control lines 162, 170 may be used to provide hydraulic power to the elevator 102 to position the elevator doors 122 from an open position to a closed position for supporting a tubular member 120.

In some embodiments, the first control lines 162 are coupled to the first elevator link 104 so that one or more first fluid flowpaths may be formed between the elevator 102 and the top drive 110. The first fluid flowpaths formed by the first control lines 162 extend from the first control unit 164, through the first control line 162, through the first passage system 156, and to the top drive 110. The second control lines 170 are coupled to the second elevator link 106 so that one or more second fluid flowpaths may be formed between the top drive 110 and the elevator 102. The fluid flowpaths formed by the second control line 170 extends from the second control unit 172, through the second control line 170, through the second passage system 158, and to the elevator 102.

In some embodiments, transmission lines extend through the passage system 156, 158. The transmission lines may include electrical conductors for transmitting electrical signals. The electric signals transmitted may be for transmitting information signals or power. For example, the transmission lines may be used to provide electrical power to the elevator 102 to position the elevator doors 122 from an open position to a closed position for supporting a tubular member 120. For example, the transmission lines may be used to transmit signals between the first control unit 164 and a sensor 166 disposed on the elevator 102 and a sensor 168 disposed on top drive 110. The sensor 166 may be used to detect and signal to the first control unit 164 that the elevator doors 122 are in a closed position. The first control unit 164 may also transmit signals through the transmission lines to the top drive 110 to control operation of the top drive 110 and elevator 102. The sensor 168 disposed proximate the top drive 110 may be used to detect and signal to the first control unit 164 position information of the top drive 110. The elevator 102 and top drive 110 each may be equipped with a plurality of sensors 166, 168.

The top drive 110 may be used to raise, lower, or tilt the elevator 102 and supported tubular member 120. The transmission signals transmitted through the transmission lines passing through the first passage system 156 to the top drive 110 may be used to control the raising, lowering, or tilting of the elevator 102 by the top drive 110. For example, the first control unit 164 may transmit to the top drive 110 a signal through the transmission lines directing the top drive 110 to raise the elevator 102 in response to information from sensor 166 that the elevator doors 122 are closed.

Figure 2:
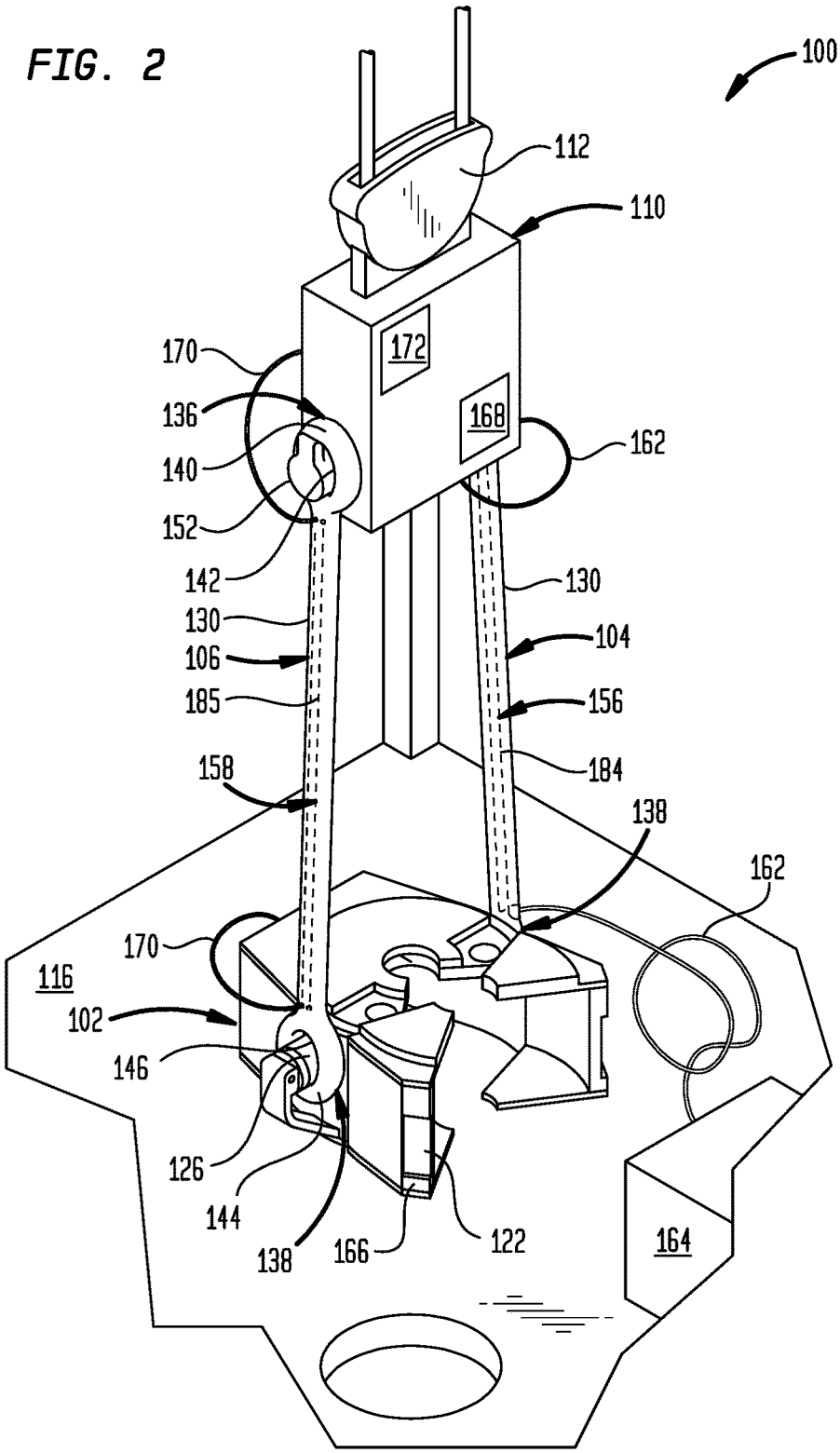
FIG. 2 depicts a schematic perspective view of the elevator system used on the rig showing the elevator doors in an open position, according to one embodiment.

FIG. 2 depicts a schematic perspective view of the elevator system 100 used on the rig 114 showing the elevator doors 122 in an open position, according to one embodiment. The upper eyes 136 of the elevator links 104, 106 each has an upper eye body 140 defining an upper eye opening 142, and the lower eye 138 has a lower eye body 144 defining a lower eye opening 146. The top drive connectors 152 extend through the upper eyes 136 of the elevator links 104, 106 to couple the elevator links 104, 106 to the top drive 110. The elevator ears 126 extend through the lower eyes 138 to couple the elevator links 104, 106 to the elevator 102.

The upper eye 136 may be coupled to the upper shaft end and the lower eye 138 may be coupled to the lower shaft end by any means, such as by welding two separate pieces together or by forging the eyes 136, 138 and the shaft 130 from a single piece of material. For example, the elevator links 104, 106 may be forged from a metallic material, and support the weight of the elevator 102 and the tubular member 120. The upper eye 136, the lower eye 138 and the shaft 130 of the elevator link 104 may be formed from one piece of material. When formed from one piece of material, the upper eye 136 is coupled to the upper shaft end and the lower eye 138 is coupled to the lower shaft end during a manufacturing process, such as a forging process.

Figure 3:
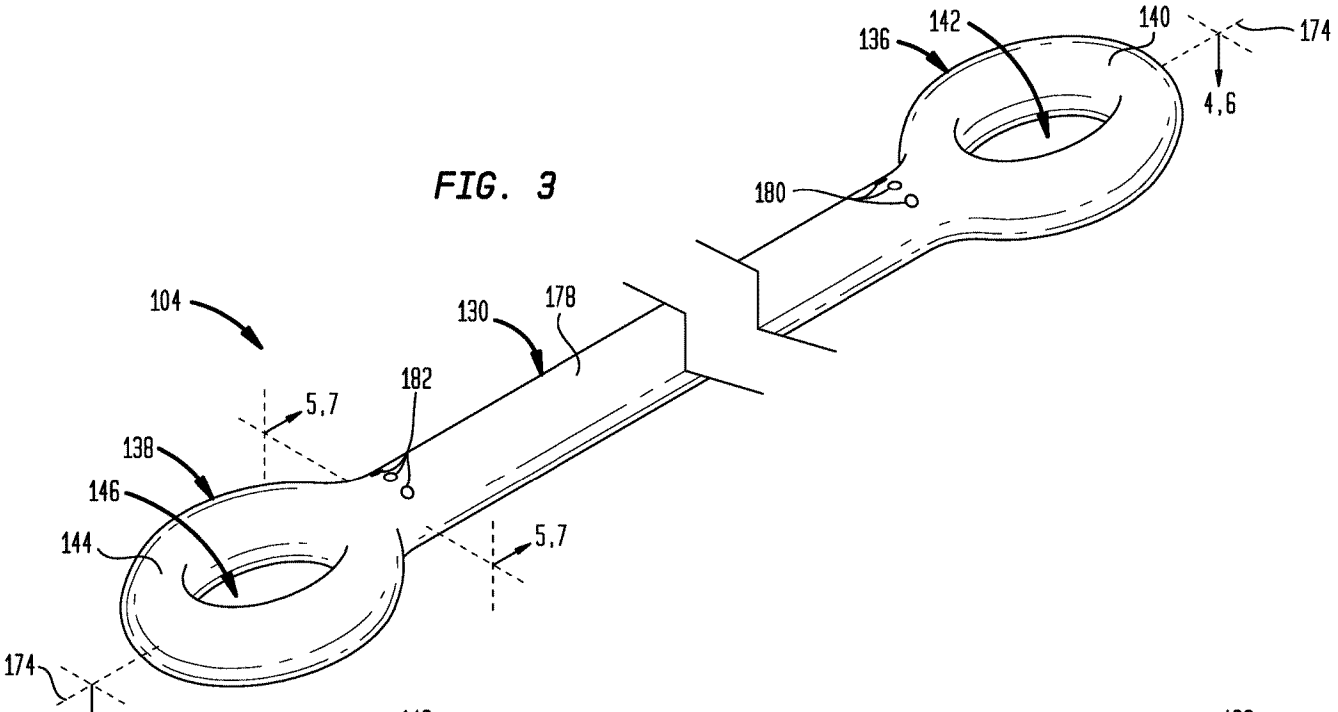
FIG. 3 depicts a schematic perspective view of an elevator link, according to one embodiment.
Figure 4:
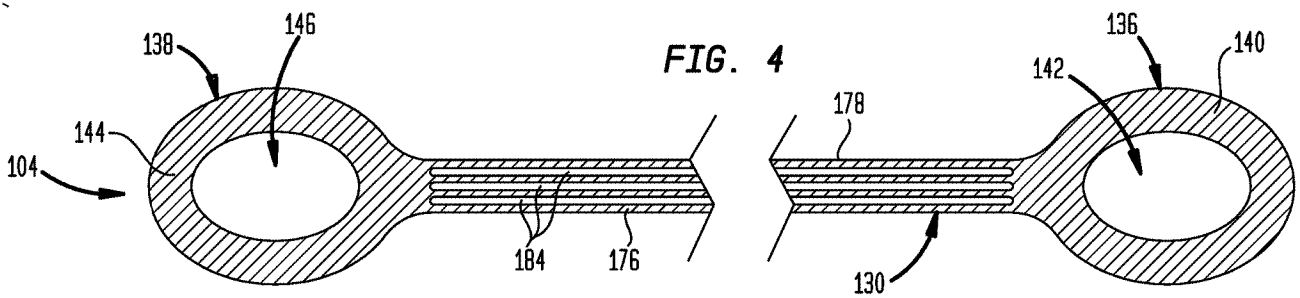
FIG. 4 depicts a cross-sectional view of the elevator link shown in FIG. 3 extending along a longitudinal axis of the elevator link, according to one embodiment.

FIG. 3 depicts a schematic perspective view of the elevator link 104, according to one embodiment. The elevator link 106 may have a similar design as the elevator link 104. FIG. 4 depicts a cross-sectional view of the elevator link 104 extending along a longitudinal axis 174 of the elevator link 104, according to one embodiment. Referring to FIG. 3 and FIG. 4, the shaft 130 of the elevator link 104 includes a shaft body 176 and a link outer surface 178. The first passage system 156, shown in FIG. 1, includes a plurality of upper ports 180 and a plurality of lower ports 182 that extend through the link outer surface 178 and into the shaft body 176. In the embodiment shown in FIG. 3, a first upper port 180, a second upper port 180, and a third upper port 180 are shown. Likewise, a first lower port 182, a second lower port 182, and a third lower port 182 are shown. A plurality of internal passages 184 extend through the shaft body 176 and between the upper ports 180 and the lower ports 182. In the embodiment shown in FIGS. 3-4, the internal passages 184 extend longitudinally through the shaft body 176. In some embodiments, the internal passages 184 may extend in parallel with longitudinal axis 174. The internal passages 184 extend through at least a portion of the shaft 130 and extend between and are in fluid communication with the first upper port 180 and the first lower port 182.

Figure 5:
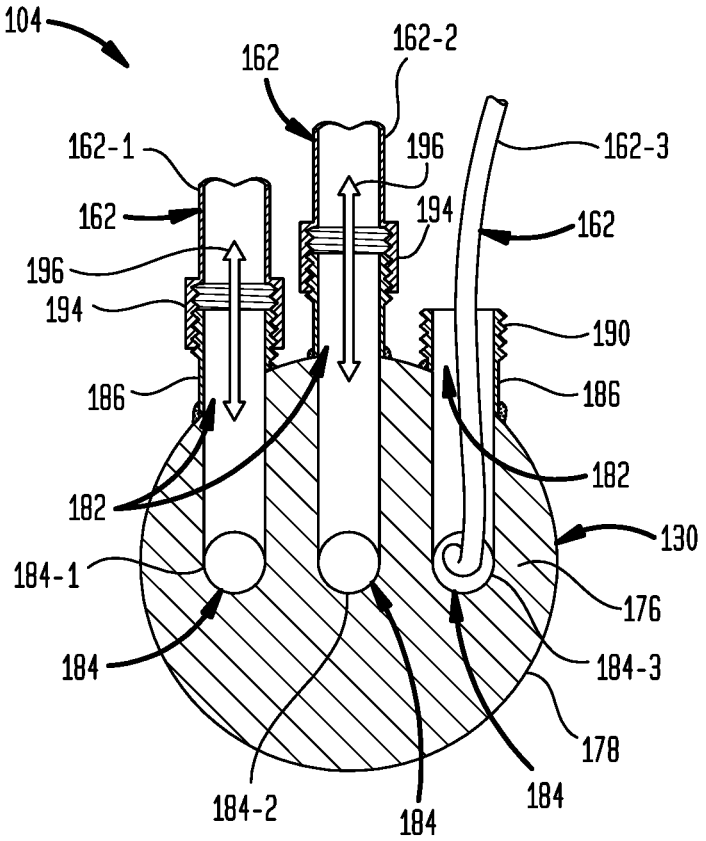
FIG. 5 depicts a cross-sectional view of the elevator link of FIG. 3 extending along a transverse axis of the elevator link with control lines shown, according to one embodiment.

FIG. 5 depicts a cross-sectional view of the elevator link 104 of FIG. 3 extending along a transverse axis of the elevator link 104 with the first control lines 162 shown, according to one embodiment. As shown in FIG. 5, each internal passage 184 is coupled to one of the lower ports 182. Three internal passages 184 are shown. In other embodiments, there may be another number of internal passages 184, for example there may be one to ten internal passages 184. Each internal passage 184 includes a longitudinal section that extends through the shaft 130 of the elevator link 104. In some embodiments, the longitudinal sections of the internal passages 184 extend parallel to the longitudinal axis 174 of the shaft 130, and a transverse section that extends from the longitudinal section to the lower port 182 coupled to the internal passage 184. Each internal passage 184 also is coupled to one of the upper ports 180, in a manner as described with respect to the lower ports 182.

The elevator link 104 may further include a plurality of port housings 186. Disposed proximate each lower port 182 is one of the port housings 186. In the embodiment shown, each port housing 186 is disposed on and extends outwardly from the link outer surface 178. Each port housing 186 surrounds one of the lower ports 182. The port housing 186 includes a port connector 190. The port connector 190 is in the form of a plurality of external threads. In other embodiments, the port connector 190 may be in the form of a plurality of internal threads, snap-on connectors, or other conventional connectors.

The port housings 186 may be used to connect the internal passages 184-1, 184-2 and the lower ports 182 to the first control lines 162-1, 162-2. The first control lines 162-1, 162-2 include a control line connector 194. The control line connector 194 has a plurality of internal threads that detachably connect to the port connectors 190. The first control lines 162-1, 162-2 may be in the form of fluid lines, for example hoses, that handle pressurized fluid flowing from the control units 164, 172. For example, pressurized fluid may flow from the first control unit 164 through the control lines 162-1, 162-2, and through the lower ports 182 to the internal passages 184-1, 184-2 that are in fluid communication with the control lines 162-1, 162-2. Fluid flow arrows 196 illustrate fluid flow through the internal passages 184 of the first elevator link 104. The internal passages 184-1, 184-2 and the control lines 162-1, 162-2 together form a fluid flowpath for flowing fluid between the elevator 102 and the top drive 110.

In one embodiment, a first control line 162-3 may be inserted through the internal passage 184-3. The first control line 162-3 extends through the internal passage 184-3 and extends through the port 182 and outwardly from the link outer surface 178. A port housing 186 may be attached proximate the port 182 and the first control line 162-3 extends outwardly from the port housing 186.

As depicted in FIGS. 1 and 2, the first control lines 162 may extend through the elevator link 104. As depicted in FIG. 5, the first control line 162-3 (which may be inserted into one of the first upper ports 180) is shown extending through the first internal passage 184-3 and out one of the first lower ports 182. The first control line 162-3 may be in the form of a fluid line for handling pressurized fluid, for example pressurized fluid used by the elevator 102 or top drive 110. In other embodiments, the first control line 162-3 may be in the form of an optical or electrical line for use in transmitting optical or electrical informational signals. In other embodiments, the first control line 162-3 may be in the form of an electrical power transmission line.

Figure 6:
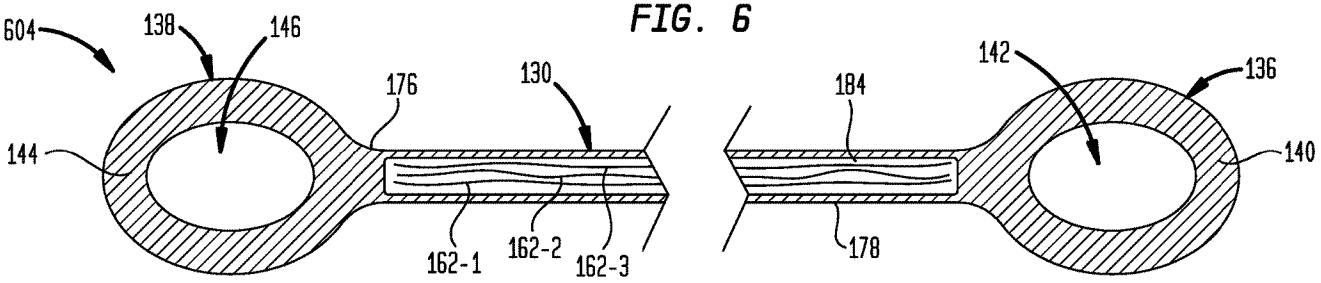
FIG. 6 depicts a cross-sectional view of the elevator link shown in FIG. 3 extending along a longitudinal axis of the elevator link with control lines shown, according to another embodiment.
Figure 7:
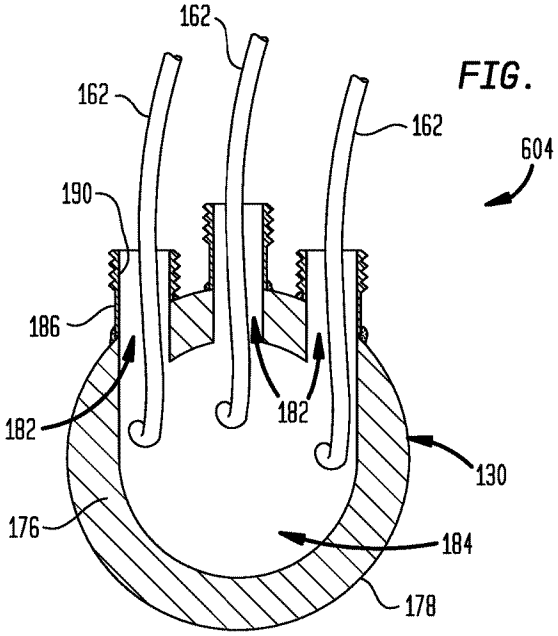
FIG. 7 depicts a cross-sectional view of the elevator link of FIG. 3 extending along a transverse axis of the elevator link with control lines shown, according to the embodiment shown in FIG. 6.

Referring to FIG. 6 and FIG. 7, another embodiment of an elevator link 604 is shown. The elevator link 604 includes a single internal passage 184 extending longitudinally through the shaft 130. The internal passage 184 is formed by the shaft body 176. In this embodiment, there are three lower ports 182 that extend through the shaft body 176 and through the link outer surface 178. The ports 182 are coupled to the internal passage 184. In other embodiments, there may be a different number of lower ports 182 that are coupled to the internal passage 184. For example, in some embodiments there may be a range of one to ten ports 182 coupled to the internal passage 184.

A plurality of first control lines 162 extend through the internal passage 184 from one end of the shaft 130 to the other end of the shaft 130. In the embodiment shown, there are three first control lines 162. Each first control line 162 extends through a lower port 182. The plurality of first control lines 162 can be separated by having each first control line 162 pass through a lower ports 182 to reduce tangling of the first control lines 162 extending outwardly from the elevator link 604.

Port housings 186 are coupled to the shaft 130, as discussed with respect to FIG. 5, and the control lines 162 extend therethrough. In some embodiments, the port housings 186 are not included. The control lines 162 may be in the form of fluid lines for handling pressurized fluid, optical or electrical signal lines for use in transmitting optical or electrical informational signals, electrical power transmission lines for transmitting electrical power, or any combination of fluid lines, optical lines, electrical lines, or electrical power transmission lines.

Figure 8:
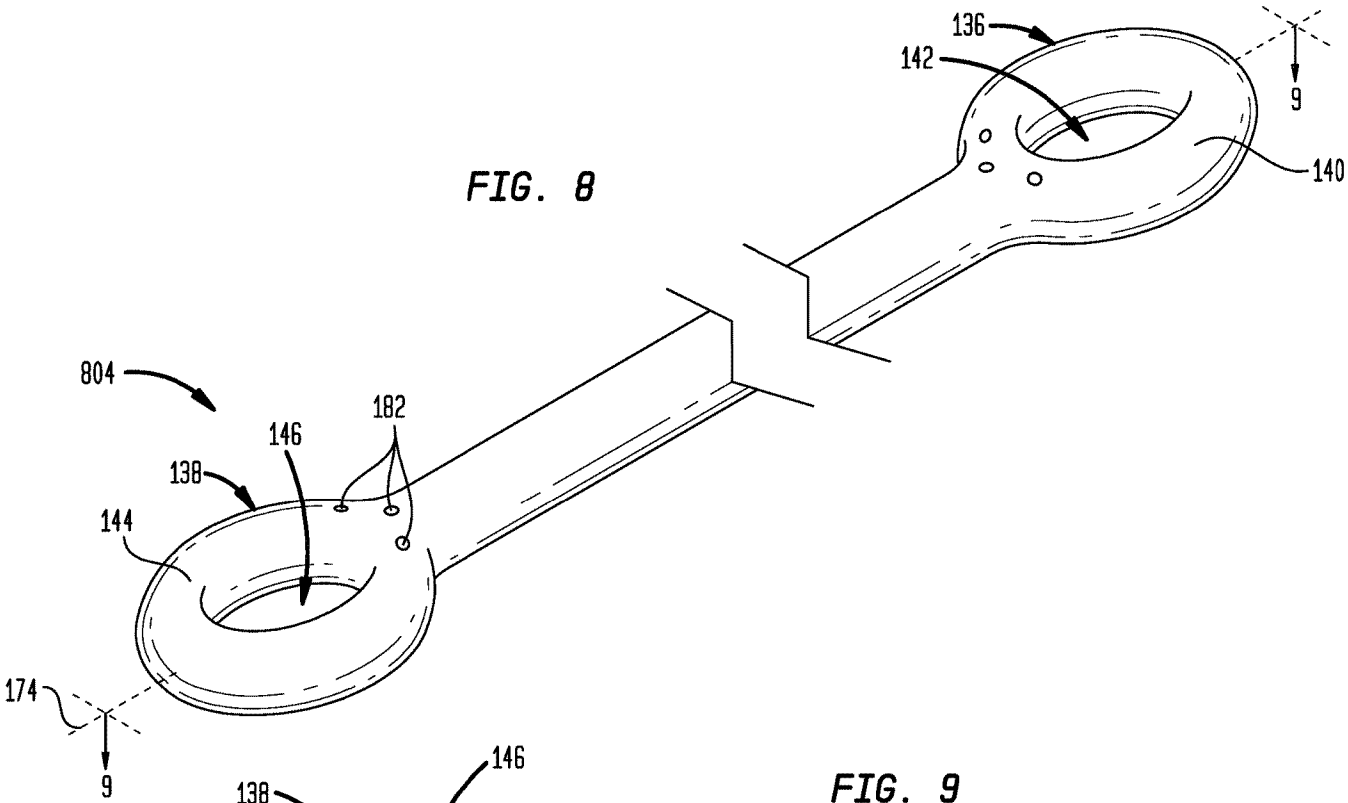
FIG. 8 depicts a schematic perspective view of an elevator link, according to one embodiment.
Figure 9:
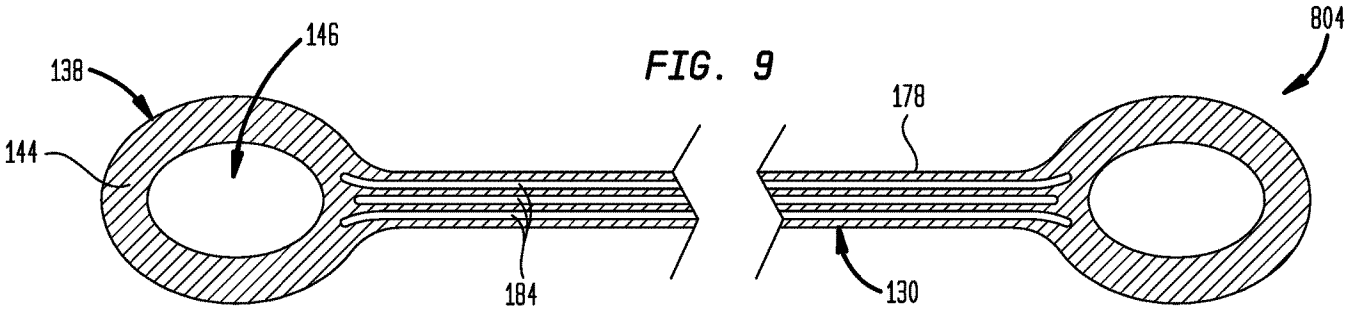
FIG. 9 depicts a cross-sectional view of the elevator link shown in FIG. 8 extending along a longitudinal axis of the elevator link, according to one embodiment.

Referring to FIG. 8 and FIG. 9, another embodiment of an elevator link 804 is shown. The elevator link 804 shown in FIG. 8 and FIG. 9 is similar to the elevator link 104 shown in FIGS. 3-5 except that the lower ports 182 are disposed on the lower eye 138 and the upper ports 180 are disposed on the upper eye 136. In the embodiment shown, one of the lower ports 182 is longitudinally separated from the other two lower ports 182. In other embodiments, the lower ports 182 may be aligned on the lower eye 138 along a transverse axis or the lower ports 182 may be positioned to at least partially encircle lower eye opening 146.

In operation, the elevator system 100 is provides a method of supporting a tubular member 120. The elevator system 100 may use hydraulic power during an operation to secure and move the tubular member 120. For example, a first control line 162 is coupled to the first elevator link 104 of the elevator system 100. The first control line 162 is in fluid communication with one of the lower ports 182 and at least one of the internal passages 184. A fluid may be pumped through the first control line 162 and through the at least one internal passage 184 of the elevator link 104. The fluid may be pumped from the control unit 164. The fluid that is being pumped flows between the elevator 102 and the top drive 110. The second control line 170 may be connected to the second elevator link 106. The second control line 170 is in fluid communication with one of the upper ports 180 and at least one of the internal passages 185. A fluid may be pumped through the second control line 170 and through the at least one internal passage 185 of the elevator link 106.

The elevator system 100 uses the fluid as hydraulic power for the elevator system 100. For example, the fluid provided to the may be used as hydraulic power to move the elevator doors 122 between the open position and the closed position. The fluid may be used as hydraulic power to lower, raise, rotate, or tilt the elevator 102.

The elevator system 100 also may use electrical power, electrical communication signals, or optical signals during an operation to secure and move the tubular member 120. For example, the first control line 162 may be in the form of an electrical line that is inserted through the internal passage 184 and extends through the internal passage 184. The first control line 162 may provide a transmission path between at least one of the sensors 166, 168 and at least one of the control units 164, 172.

The elevator system 100 is configured to integrate the control lines 162, 170 with the elevator links 104, 106 to form an elevator link transmission path between the elevator 102 and the top drive 110. The use of the internal passages 184, 185 as part of the elevator link transmission path reduces the length of control lines 162, 170 disposed external to the elevator links 104, 106 in an unprotected location. Integrating the control lines 162, 170 with the elevator links helps reduce tangling or damage of the control lines 162, 170.

While the foregoing is directed to embodiments of the disclosure, other and further embodiments of the disclosure may be devised without departing from the basic scope thereof, and the scope thereof is determined by the claims that follow.

The invention claimed is:

1. An elevator system for supporting a tubular member, comprising:

an elevator;

a first elevator link connected to the elevator for supporting the elevator, comprising:

a shaft having an upper shaft end and a lower shaft end;

an upper eye coupled to the upper shaft end and having an upper eye body defining an upper eye opening;

a lower eye coupled to the lower shaft end and having a lower eye body defining a lower eye opening;

a first upper port and a first lower port disposed on the first elevator link;

a first internal passage extending through at least a portion of the shaft and in communication with the first upper port and the first lower port;

a first control line having an upper line section coupled to and in communication with the first upper port and a lower line section coupled to and in communication with the first lower port, wherein the first internal passage and the first control line form a first fluid flowpath; and a second elevator link connected to the elevator for supporting the elevator.

2. The elevator system of claim 1, further comprising a port housing having a port connector, wherein the lower line section is configured to connect to the port connector so as to detachably connect the lower line section to the first lower port so that the lower line section is in communication with the first lower port.

3. The elevator system of claim 2, wherein another control line is disposed within and extends through the first upper port, the first internal passage, and the first lower port.

4. The elevator system of claim 2, wherein the first elevator link comprises a second upper port and a second lower port disposed on the first elevator link, and wherein the first elevator link comprises a second internal passage extending between the second upper port and the second lower port.

5. The elevator system of claim 2, wherein the first control line is coupled to a first control unit, and wherein the first control line is coupled to the elevator and is an electrical line or optical line configured to transmit electrical or optical signals between the first control unit and the elevator.

6. The elevator system of claim 1, wherein the first upper port is disposed towards the upper shaft end and the first lower port is disposed towards the lower shaft end.

7. The elevator system of claim 2, wherein the first elevator link further comprises a second upper port and a second lower port disposed on the first elevator link, wherein the first internal passage is coupled to and in fluid communication with the second upper port and the second lower port.

8. The elevator system of claim 1, wherein the elevator comprises an elevator body, an elevator ear attached to the elevator body, and wherein the elevator ear extends through the lower eye so as to connect the first elevator link to the elevator for supporting the elevator.

9. An elevator link configured to couple an elevator to a top drive for supporting a tubular member, comprising:

a shaft having an upper shaft end and a lower shaft end;

an upper eye coupled to the upper shaft end and having an upper eye body defining an upper eye opening;

a lower eye coupled to the lower shaft end and having a lower eye body defining a lower eye opening;

a first upper port and a first lower port disposed on the elevator link;

a first internal passage extending through at least a portion of the shaft and in communication with the first upper port and the first lower port; and a first control line having an upper line section coupled to and in communication with the first upper port and a lower line section coupled to and in communication with the first lower port, wherein the first internal passage and the first control line form a first fluid flowpath.

10. The elevator system of claim 9, further comprising a port housing having a port connector, wherein the lower line section is configured to connect to the port connector so as to detachably connect the lower line section to the first lower port so that the lower line section is in communication with the first lower port.

11. The elevator system of claim 9, wherein another control line is disposed within and extends through the first upper port, the first internal passage, and the first lower port.

12. The elevator system of claim 9, wherein the first lower port is disposed on the lower eye.

13. The elevator system of claim 9, wherein the elevator link further comprises a second upper port and a second lower port disposed on the first elevator link, wherein the first internal passage is coupled to and in fluid communication with the second upper port and the second lower port.

14. The elevator system of claim 9, wherein the elevator link comprises a second upper port and a second lower port disposed on the first elevator link, and wherein the elevator link comprises a second internal passage extending between the second upper port and the second lower port.

15. The elevator system of claim 14, further comprising one or more control lines extending through at least one of the second and second internal passages, and wherein at least one of the control lines is an electrical line or an optical line.

16. A method of supporting a tubular member with an elevator system, comprising:

coupling a first control line to a first elevator link of the elevator system, wherein the first elevator link comprises a shaft, and a first upper port and a first lower port disposed on the elevator link, wherein a first internal passage extends through at least a portion of the shaft, and wherein the first internal passage is in communication with the first upper port and the first lower port; and pumping fluid through the first control line and through the first internal passage; and using the fluid as hydraulic power for the elevator system.

17. The method of claim 16, wherein the first control line has an upper line section coupled to and in communication with the first upper port and a lower line section coupled to and in communication with the first lower port, and wherein the first internal passage and the first control line form a first fluid flowpath.

18. The method of claim 17, wherein the elevator link further comprises a second upper port and a second lower port disposed on the first elevator link, and a second internal passage extending between the second upper port and the second lower port, wherein the first elevator link includes a plurality of first control lines, and wherein at least one of the first control lines is coupled to the second internal passage.

19. An elevator system for supporting a tubular member, comprising:

an elevator;

a first elevator link connected to the elevator for supporting the elevator, comprising:

a shaft having an upper shaft end and a lower shaft end;

an upper eye coupled to the upper shaft end and having an upper eye body defining an upper eye opening;

a lower eye coupled to the lower shaft end and having a lower eye body defining a lower eye opening;

a first upper port and a first lower port disposed on the first elevator link;

a first internal passage extending through at least a portion of the shaft and in communication with the first upper port and the first lower port; and a first control line disposed within and extends through the first upper port, the first internal passage, and the first lower port; and a second elevator link connected to the elevator for supporting the elevator.

20. An elevator system for supporting a tubular member, comprising:

an elevator;

a first elevator link connected to the elevator for supporting the elevator, comprising:

a shaft having an upper shaft end and a lower shaft end;

an upper eye coupled to the upper shaft end and having an upper eye body defining an upper eye opening;

a lower eye coupled to the lower shaft end and having a lower eye body defining a lower eye opening;

a first upper port and a first lower port disposed on the first elevator link;

a first internal passage extending through at least a portion of the shaft and in communication with the first upper port and the first lower port; wherein the first internal passage and the first control line form a first fluid flowpath;

a second upper port and a second lower port disposed on the first elevator link; and a second internal passage extending between the second upper port and the second lower port; and a second elevator link connected to the elevator for supporting the elevator.

21. An elevator system for supporting a tubular member, comprising:

an elevator;

a first elevator link connected to the elevator for supporting the elevator, comprising:

a shaft having an upper shaft end and a lower shaft end;

an upper eye coupled to the upper shaft end and having an upper eye body defining an upper eye opening;

a lower eye coupled to the lower shaft end and having a lower eye body defining a lower eye opening;

a first upper port and a first lower port disposed on the first elevator link;

a first internal passage extending through at least a portion of the shaft and in communication with the first upper port and the first lower port; and a second upper port and a second lower port disposed on the first elevator link, wherein the first internal passage is coupled to and in fluid communication with the second upper port and the second lower port; and a second elevator link connected to the elevator for supporting the elevator.

22. An elevator link configured to couple an elevator to a top drive for supporting a tubular member, comprising:

a shaft having an upper shaft end and a lower shaft end;

an upper eye coupled to the upper shaft end and having an upper eye body defining an upper eye opening;

a lower eye coupled to the lower shaft end and having a lower eye body defining a lower eye opening;

a first upper port and a first lower port disposed on the elevator link;

a first internal passage extending through at least a portion of the shaft and in communication with the first upper port and the first lower port; and a first control line disposed within and extends through the first upper port, the first internal passage, and the first lower port.

23. An elevator link configured to couple an elevator to a top drive for supporting a tubular member, comprising:

a shaft having an upper shaft end and a lower shaft end;

an upper eye coupled to the upper shaft end and having an upper eye body defining an upper eye opening;

a lower eye coupled to the lower shaft end and having a lower eye body defining a lower eye opening;

a first upper port and a first lower port disposed on the elevator link, wherein the first lower port is disposed on the lower eye; and a first internal passage extending through at least a portion of the shaft and in communication with the first upper port and the first lower port.

24. An elevator link configured to couple an elevator to a top drive for supporting a tubular member, comprising:

a shaft having an upper shaft end and a lower shaft end;

an upper eye coupled to the upper shaft end and having an upper eye body defining an upper eye opening;

a lower eye coupled to the lower shaft end and having a lower eye body defining a lower eye opening;

a first upper port and a first lower port disposed on the elevator link;

a first internal passage extending through at least a portion of the shaft and in communication with the first upper port and the first lower port; and a second upper port and a second lower port disposed on the elevator link, wherein the first internal passage is coupled to and in fluid communication with the second upper port and the second lower port.

25. An elevator link configured to couple an elevator to a top drive for supporting a tubular member, comprising:

a shaft having an upper shaft end and a lower shaft end;

an upper eye coupled to the upper shaft end and having an upper eye body defining an upper eye opening;

a lower eye coupled to the lower shaft end and having a lower eye body defining a lower eye opening;

a first upper port and a first lower port disposed on the elevator link;

a first internal passage extending through at least a portion of the shaft and in communication with the first upper port and the first lower port;

a second upper port and a second lower port disposed on the elevator link; and a second internal passage extending between the second upper port and the second lower port.

* * * * *